US006969098B2

(12) United States Patent
Olsen

(10) Patent No.: US 6,969,098 B2
(45) Date of Patent: Nov. 29, 2005

(54) NON-ELEVATING HANDLE FOR CENTER LIFT CARRIER

(75) Inventor: Robert C. Olsen, Madinah, IL (US)

(73) Assignee: Illinois Tool Works Inc., Glenview, IL (US)

( * ) Notice: Subject to any disclaimer, the term of this patent is extended or adjusted under 35 U.S.C. 154(b) by 163 days.

(21) Appl. No.: 10/190,053

(22) Filed: Jul. 3, 2002

(65) Prior Publication Data

US 2004/0004365 A1 Jan. 8, 2004

(51) Int. Cl.[7] ..... B66C 1/10

(52) U.S. Cl. ..... 294/87.2; 206/150; 206/151; 206/161; 206/162; 206/199; 220/DIG. 29

(58) Field of Search ..... 294/87.2, 159; 206/150, 151, 161, 162, 199; 220/DIG. 29

(56) References Cited

U.S. PATENT DOCUMENTS

| | | | | |
|---|---|---|---|---|
| 2,874,835 A | | 2/1959 | Poupitch | 206/65 |
| 2,989,177 A | | 6/1961 | Swick | 206/65 |
| 3,232,422 A | | 2/1966 | Whyte | 206/56 |
| 5,265,718 A | | 11/1993 | Marco | 206/150 |
| 5,437,364 A | | 8/1995 | Broskow | 206/150 |
| 5,487,465 A | | 1/1996 | Broskow | 206/150 |
| 5,593,026 A | | 1/1997 | Broskow | 206/150 |
| 5,642,808 A | | 7/1997 | Marco et al. | 206/150 |
| 5,655,654 A | | 8/1997 | Broskow | 206/150 |
| 5,657,863 A | * | 8/1997 | Olsen | 206/150 |
| 5,788,301 A | | 8/1998 | Slomski | 294/87 |
| 5,806,667 A | | 9/1998 | Marco | 206/150 |
| 6,152,508 A | | 11/2000 | Slomski | 294/87.2 |

FOREIGN PATENT DOCUMENTS

| | | | |
|---|---|---|---|
| EP | 0 997 389 | 10/1999 | B65D 71/50 |

* cited by examiner

*Primary Examiner*—Khoi H. Tran
*Assistant Examiner*—Michael Lowe
(74) *Attorney, Agent, or Firm*—Taylor & Aust, P.C.

(57) ABSTRACT

A container carrier especially suitable for larger containers and for packages having a larger number of containers, to provide a feeling of strength as the carrier is lifted. The carrier includes loops for surround and retaining each container, a handle portion and linear struts connecting ends of the handle to outermost loops holding containers. As the containers are lifted, minimal movement of the handle occurs relative to the containers. A supply of the carriers includes multiple carriers connected in an end-to-end arrangement by two separate frangible links.

9 Claims, 4 Drawing Sheets

NON-ELEVATING HANDLE FOR CENTER LIFT CARRIER

FIELD OF THE INVENTION

The present invention relates generally to packaging devices, and, more particularly, to a plastic toplift carrier for holding and carrying a plurality of containers such as bottles, cans and the like.

BACKGROUND OF THE INVENTION

Different types of carriers for bottles, cans and other containers are known. Both cardboard and plastic are materials commonly used. One such type of carrier is made of stretchable plastic, with apertures therein that stretch and engage the periphery of the container. A number of containers are held in an aligned row, or in a plurality of adjacent aligned rows.

For convenient carrying of a group of containers held by the carrier, various types of hand-grasps are known. For example, it is known to provide holes for finger-tip grasping of the package. It is also known to provide a handle on the carrier, either along one side of the group of containers or at the tops of the containers.

In one such known design, the carrier is formed from two webs of plastic material juxtaposed over one another. Handle portions and container engaging portions are stamped from the juxtaposed webs simultaneously. The webs are fused or welded along selected portions such as by heat sealing. The resulting handle portion is thereby a double thickness of material and the container engaging portions freely depend from the remainder of the carrier, from either side thereof. The container engaging portions are a single ply of material, and may include one or more rows of container engaging apertures. When assembled with the containers attached, the handle projects upwardly from the tops of the containers, centrally located between the aligned rows of containers.

It is known to use both the stretchiness of the plastic material and the design of the carrier itself to allow the handle to stretch and/or extend away from the containers as the package of containers is lifted. In a carrier of this type, the handle nests between the containers until the handle is grasped and the package lifted. It is known to design the handle, and the connection between the handle and the remainder of the carrier, to allow the handle to elongate and narrow as the package is lifted. Inwardly directed straps from the outer ends of the handles form "elbows" that straighten as the package is lifted, thereby generally moving away from the tops of the containers and providing separation between a hand of the person carrying the package and the tops of the containers. Stretching and/or elongating of the handle in this manner reduces the chance that the persons hand or knuckles with rap against the top of the containers, and thereby provides a more comfortable carrying arrangement.

Such carriers have achieved wide acceptance for use with six packs of twelve ounce containers, for example. More recently, marketing demands have tended toward the packaging of larger volume containers and/or more containers in a single package. While the plastic material used, and the structural designs of such previous carriers are adequately strong for carrying larger packages of containers, the natural stretchiness of the material and the elongation and narrowing of the handle as the package is lifted can provide a sensation that the carrier is about to fail structurally. Thus, it is desirable to provide a more ridged or taut feel to the carrier as a person carries the package with all containers suspended from a relatively thin and flexible handle on the carrier.

A more stiff or taut feeling can be achieved using a substantially solid web of material, with apertures provided only for the handle and the container engaging portions. However, the amount of material required for a carrier of this type would make the carrier expensive to manufacture, requiring a significant amount of plastic material, making the final cost unacceptably high. It is desirable to make the carrier both light weight and inexpensive, since a carrier is used only once and then recycled. Therefore, it is advantageous to minimize the volume of material required for the carrier, as much as possible.

SUMMARY OF THE INVENTION

The present invention provides a carrier for containers such as bottles, cans and the like that includes a handle portion and a carrier portion depending therefrom, the carrier portion securing and holding a plurality of the containers in one or more aligned rows on either side of the handle. The handle portion is attached to the carrier portion to provide minimized stretching and/or elongation of the handle as the package is lifted.

The invention provides, in one form thereof, a container carrier with a handle having a first end and a second end, and an array of loops for holding containers arranged in a row. The array includes a first end loop and a second end loop, with remaining the loops disposed between the first end loop and the second end loop. A suspension portion interconnects the handle and the array. The suspension portion includes a substantially linear first end strut connecting the first end of the handle to the first end loop, and a substantially linear second end strut connecting the second end of the handle to the second end loop.

The invention provides, in another form thereof, a container carrier with an array of loops for holding containers, the array of loops including first and second end loops and other loops disposed in substantial alignment between the first and second end loops. A handle includes a first handle end and a second handle end. Substantially linear support is provided between the first and second handle ends and the first and second end loops, respectively.

In a further form thereof, the invention provides a container carrier with first and second sheets in juxtaposition, each having a handle portion, a container holding portion and a suspension portion interconnecting the handle portion to the container holding portion. At least one line of securement is provided between the first sheet and the second sheet. The container holding portions of the sheets extend outwardly of the at least one line of securement. The container holding portions are each adapted to retain separate rows of containers, each row having first and second outer most containers. The suspension portions include linear struts connecting the handle portions with the container holding portions near the outer most containers.

In yet another form thereof, the invention provides a package of containers with first and second rows of containers, each row including a first outer most container and a second outer most container. A carrier includes a first array of loops for securing individually therein each container of the first row; a second array of loops for securing individually therein each container of the second row; a handle; and linear struts from the handle to the loops securing the first and second outer most containers.

In still another form thereof, the invention provides a supply of carriers for attachment to containers, with a plurality of individual carriers each having a handle portion, a container holding portion and a suspension portion. Individual carriers of the plurality are arranged in end to end alignment. Adjacent carriers are connected to each other by at least two spaced frangible links.

An advantage of the present invention is providing a light weight and inexpensive carrier for heavier packages of containers such as bottles, cans and the like.

Another advantage of the present invention is providing a carrier for containers such a bottles, cans or the like having a handle portion and a container holding portion, with the handle portion more firmly secured in position relative to the container holding portion.

Yet another advantage of the present invention is providing a plastic carrier for containers such a bottles, cans and the like which can be manufactured easily and quickly using known manufacturing techniques.

A further advantage of the present invention is providing an inexpensive plastic carrier for containers such as bottles, cans and the like that conveys a firm and secure feel of the package to a person carrying the package suspended from a handle of the carrier.

Other features and advantages of the invention will become apparent to those skilled in the art upon review of the following detailed description, claims and drawings in which like numerals are used to designate like features.

Figure 1:
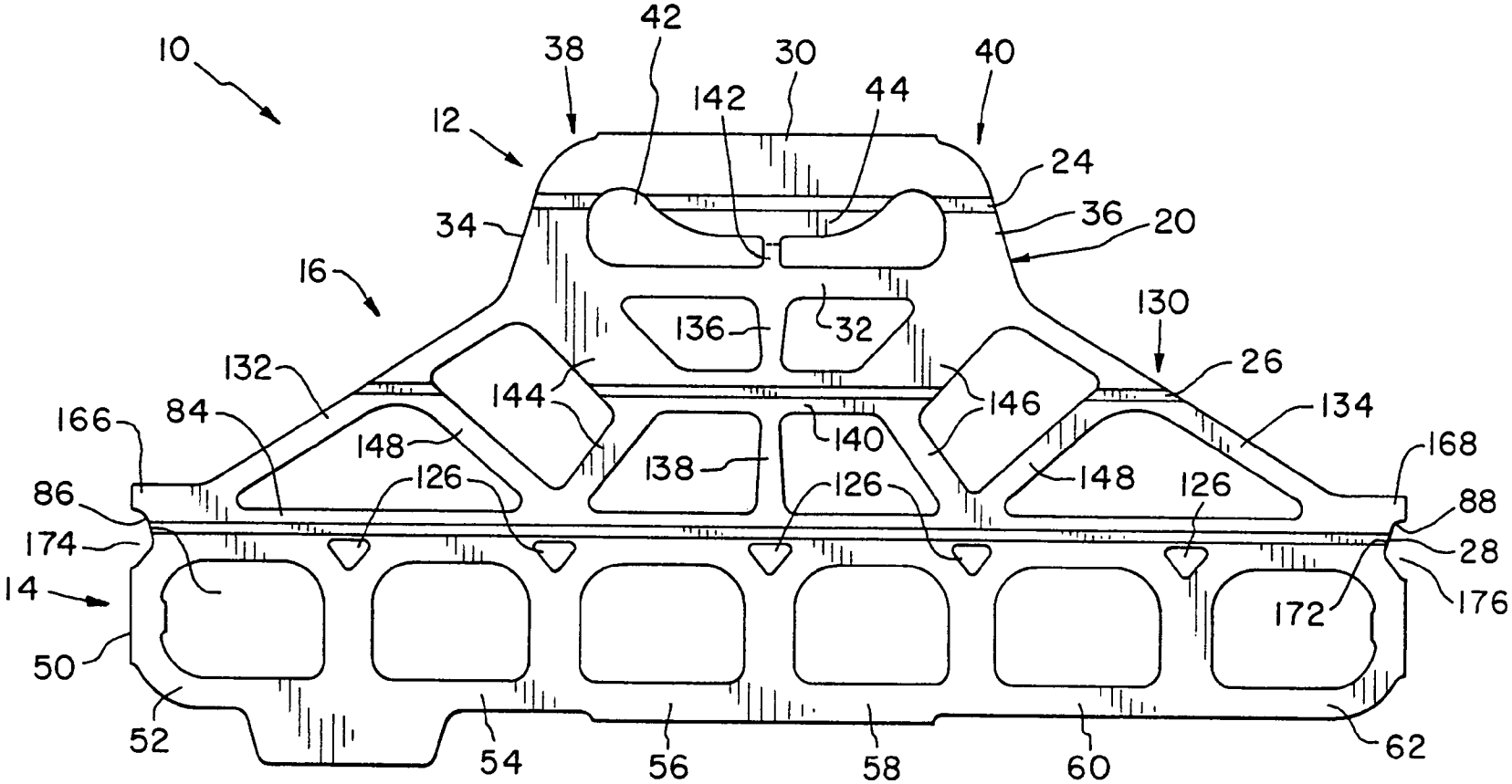
FIG. 1 is an elevational view of a first side of a carrier according to the present invention.

Before the embodiments of the invention are explained in detail, it is to be understood that the invention is not limited in its application to the details of construction and the arrangements of the components set forth in the following description, or illustrated in the drawings. The invention is capable of other embodiments, and of being practiced or being carried out in various ways. Also, it is understood that the phraseology and terminology used herein are for the purpose of description, and should not be regarded as limiting. The use herein of "including", "comprising", and variations thereof, is meant to encompass the items listed thereafter, and equivalents thereof, as well as additional items and equivalents thereof.

DETAILED DESCRIPTION OF THE PREFERRED EMBODIMENT

Figure 2:
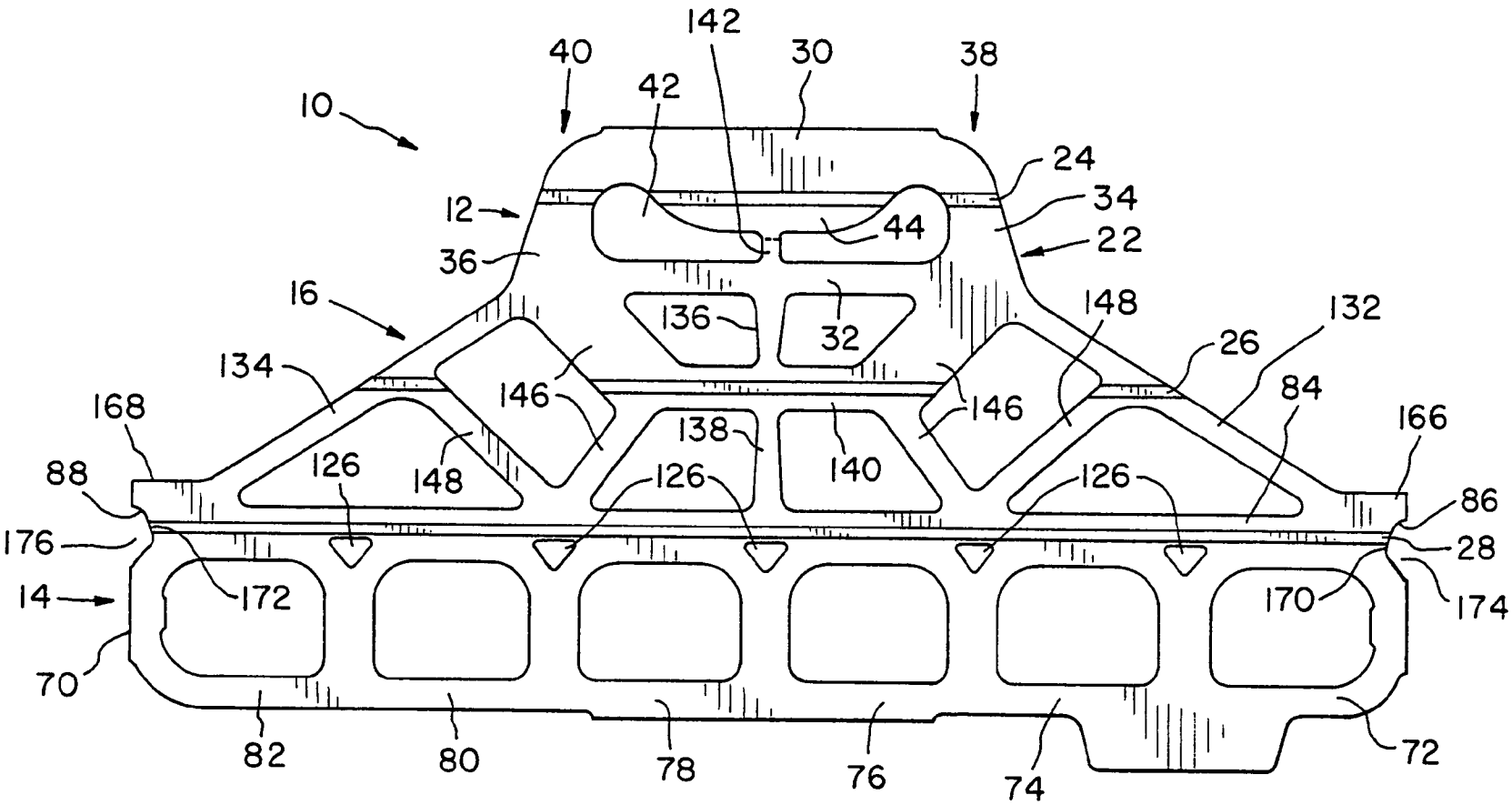
FIG. 2 is an elevational view of the carrier of FIG. 1, but showing the side opposite the side of the carrier shown in FIG. 1.

Referring now more specifically to the drawings, and to FIGS. 1 and 2 in particular, numeral 10 designates a container carrier in accordance with the present invention. Carrier 10 includes a handle portion 12 and a container holding portion 14 connected to each other by a suspension portion 16. Carrier 10 is made of flexible, resilient material that can be stretched significantly without breaking. Low density polyethylene is a suitable plastic from which carrier 10 can be made.

Carrier 10 is formed of two juxtaposed webs or sheets 20 and 22, respectively, joined to each other by a plurality of welds 24, 26 and 28. Sheet 20 of carrier 10 can be seen in FIG. 1, and sheet 22 can be seen in FIG. 2. Welds 24, 26 and 28 adhere sheets 20 and 22 together in discrete areas. Three such welds 24, 26 and 28 are shown in the drawings; however, it should be understood that more or fewer welds 24, 26 and 28 can be used, and can be located in different areas of carrier 10. Further, each weld 24, 26 and 28 can be a continuously fused bond between sheets 20 and 22 throughout the length of the weld, or may include a plurality of discrete weld segments within the length of the weld. As illustrated in FIGS. 1 and 2, weld 24 near the top of carrier 10, and weld 26 generally between handle portion 12 and suspension portion 16 each include a plurality of discrete weld segments as a result of the open structure of suspension portion 16. Weld segment 28 between suspension portion 16 and container holding portion 14 includes a substantially continuous seam joining sheets 20 and 22. The manner of making welds 24, 26 and 28, such as by hot pressing with a tape of material between sheets 20 and 22 similar to the material of sheets 20 and 22, is well-known to those skilled in the art, and will not be described in greater detail herein. In the areas between welds 24, 26 and 28 sheets 20 and 22 are separate from each other, but coextensively positioned.

Sheets 20 and 22 are provided as solid sheets from edge to edge, and are processed through a punch press, in known manner, to form the configuration of carrier 10, including handle portion 12, container engaging portion 14 and suspension portion 16. Material removed during punching to create the open structure shown is readily recyclable to form additional sheets 20 and 22. Waste is minimal, and reducing the amount of material used in each carrier has a direct impact on the cost for the carrier.

Handle portion 12 is a double thick layer formed from sheets 20 and 22 secured by welds 24 and 26. Handle portion 12 in each sheet 20 and 22 includes a top segment 30, a bottom segment 32 and end segments 34 and 36 generally defining a first handle end 38 and a second handle end 40, respectively. Segments 30, 32, 34 and 36 define there between a handle opening 42, through which the hand of a person can be extended for grasping carrier 10. A downwardly depending flap 44, from top segment 30, can be provided for user comfort, by providing a widened element and a curve shape for top handle segment 30 to more readily conform to a hand grasping it. In the embodiment shown, weld 24 includes individual weld segments connecting sheets 20 and 22 at juxtaposed flaps 44, juxtaposed first end segments 34 and juxtaposed second end segments 36. Again, it should be understood that the number of and locations for welds 24, 26 and 28 can differ for different embodiments of and uses for carrier 10.

Container engaging portion 14 comprises a first array 50 of individual loops or sleeves 52, 54, 56, 58, 60 and 62 formed in first sheet 20, and a second array 70 of individual loops or sleeves 72, 74, 76, 78, 80 and 82 formed in second sheet 22, each adapted to be stretched over an end of a container to be transported in carrier 10. First and second arrays 50 and 70 extend freely and separately away from weld 28, weld 28 being formed as a continuous bond between juxtaposed stringer 84 in first and second sheets 20 and 22. Stringer 84 of each sheet 20, 22 extends adjacent the respective array 50, 70 of the sheet 20, 22. Each stringer 84 has a first stringer end 86 and a second stringer end 88. Arrays 50 and 70 in sheets 20 and 22 are not attached to each other outwardly beyond weld 28 in stringer 84, thereby allowing each array 50 and 70 to be moved laterally with respect to weld 28. Those skilled in the art will understand that the shapes of loops 52, 54, 56, 58, 60, 62, 72, 74, 76, 78, 80 and 82 will be different for different applications and uses for carrier 10, depending on the type, size and shape of containers to be secured in carrier 10. Thus, for example, the shapes thereof will be different for cans than for bottles.

Figure 3:
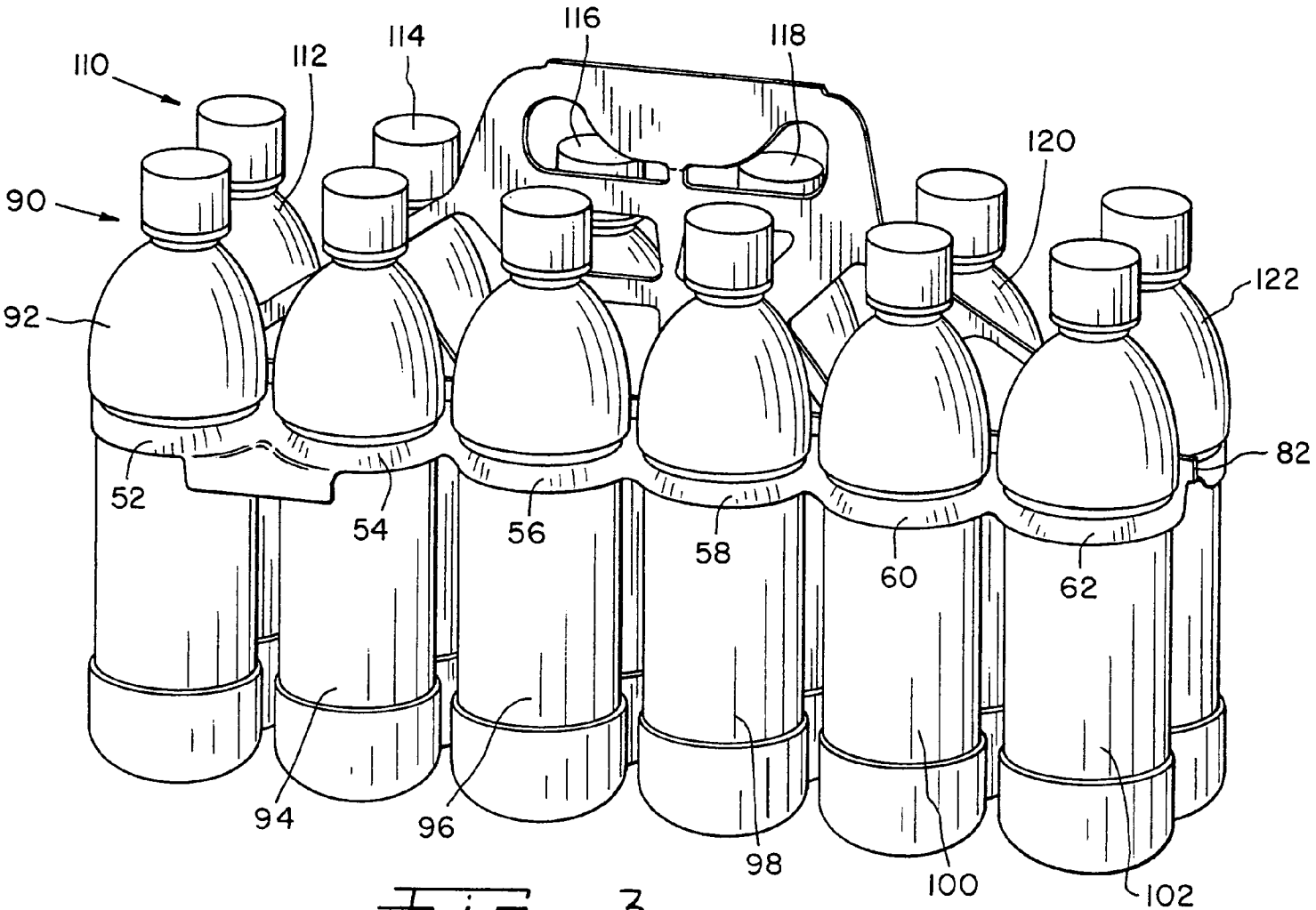
FIG. 3 is a perspective view of the carrier shown in FIGS. 1 & 2, illustrating the carrier attached to bottles.

Each loop or sleeve 52, 54, 56, 58, 60, 62, 72, 74, 76, 78, 80 and 82 is adapted to secure a container therein, individually and separately. In the embodiment illustrated, carrier 10 is capable of holding twelve containers, with six containers on each side of handle portion 14. FIG. 3 illustrates a first row 90 having six bottles 92, 94, 96, 98, 100 and 102 held by sheet 20 in loops 52, 54, 56, 58, 60 and 62; and a second row 110 of six bottles, including bottles 112, 114, 116, 118, 120 and 122 held by sheet 22 in loops 72, 74, 76, 78, 80 and 82. Carrier 10 is, therefore, adapted for securing and transporting a so-called "twelve-pack"; however, it should be understood that carrier 10 can be adapted for securing more or fewer containers. Further, carrier 10 can be adapted for securing two rows of containers on each side of handle portion 12. In such case, arrays 50 and 70 each include two adjacent rows of adjacent loops.

Apertures 126, of various size, shape and location, are cut into sheets 20 and 22 during stamping, to provide the necessary stretching and shaping of loops 52, 54, 56, 58, 60, 62, 72, 74, 76, 78, 80 and 82 to secure containers therein.

Suspension portion 16 interconnects handle portion 12 with container engaging portion 14. While suspension portion 16 could be provided as a solid, uninterrupted piece, doing so is not practical, commercially. It is preferred that carrier 10 be as inexpensive as possible. Thus, it is desirable to remove as much material as possible during stamping, to reduce cost. However, the remaining material advantageously provides a firm, taut and secure carrier, even when a large number of or large volume containers are to be transported by carrier 10.

Suspension portion 16 is a double thick layer formed from sheets 20 and 22, secured by welds 26 and 28. Suspension portion 16 in each sheet 20 and 22 includes a plurality of straps 130, including first and second end struts 132 and 134, respectively. End struts 132 and 134 interconnect first and second handle ends 38 and 40, respectively, with stringer 84 near the outermost container loops of container holding portion 14. Handle portion 12 has a length between first and second handle ends 38 and 40 less than the length of stringer 84. In a preferred embodiment, end struts 132 and 134 of each sheet 20, 22 are connected to outer loops 52, 62, and 72, 82 outwardly of a centerline of each respective loop that is perpendicular to stringer 84. Thus, first end strut 132 of each sheet 20 and 22 is stamped as a substantially straight segment angling outwardly from first handle end 38 to near the outer ends of sleeves 52 and 72, and second end strut 134 of each sheet 20 and 22 is stamped as a substantially straight segment angling outwardly from second handle end 40 to near the outer ends of sleeves 62 and 82, respectively. Each first end strut 132 and second end strut 134 are formed contiguous to stringer segments 84 in sheets 20 and 22, thereby providing a direct connection between handle portion 12 and the outermost containers secured in arrays 50 and 70, through stringers 84. Struts 132, 134 restrict the distance by which handle ends 38 and 40 can separate from the outermost containers.

To reduce downward buckling at the center of first and second arrays 50 and 70, suspension portion 16 includes center struts 136 and 138 in each sheet 20 and sheet 22, between handle portion 12 and container holding portion 14. A beam 140 also is provided in each sheet 20 and 22. Center struts 136 extend between handle bottom segments 32 and beams 140, and center struts 138 extend between beams 140 and stringers 84. For additional center stability when handling carriers 10 prior to and during attachment, handle struts 142 are provided between handle top segments 30 and bottom segments 32 in each sheet 20 and 22, substantially in alignment with center struts 136 and 138. Handle struts 142, in known manner, are designed to break as a package of containers is lifted, thereby allowing handle portion 12 to better conform for carrying comfort.

Beams 140 are of insufficient length to extend the full distance between end struts 132 and 134, and are shorter in length than handle portion 12. Angular, first elbow-like tie members 144 are provided in each sheet 20 and 22, between beams 140, stringers 84 and the juncture of first end struts 132 with handle portions 12. Angular, second elbow-like tie members 146 are provided in each sheet 20 and 22, between beams 140, stringers 84 and the juncture of second struts 134 with handle portion 12. Braces 148 connecting center portions of end struts 132, 134 to elbow members 144, 146 can be used to facilitate handling, including during the formation and application of carrier 10, by stabilizing the orientations of end struts 132 and 134.

Figure 4:
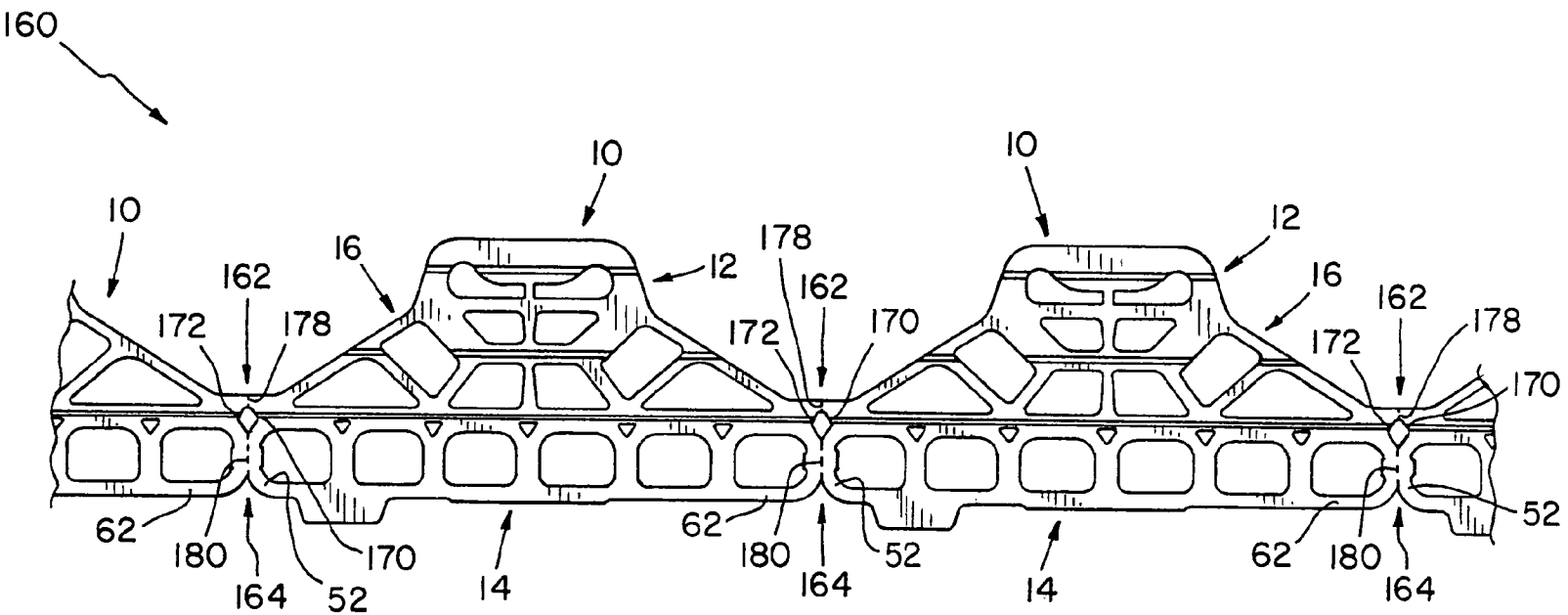
FIG. 4 is an elevational view of a supply of the carriers, prior to attachment of individual carriers to groups of containers.

FIG. 4 illustrates the manner in which carriers 10 are provided from a suitable press in which the carriers are made. Carriers 10 of the present invention are provided in a band or supply 160 that includes a plurality of carriers 10 connected in an end to end arrangement. A length of supply 160 containing a desired number of carriers 10 is wound on a spool, fan-folded in a container, or otherwise accumulated in suitable fashion to be provided to automated equipment for applying individual carriers 10 on groups of containers. It is important that the carriers remain properly oriented relative to each other, even as the handle portions 12 and arrays 50, 70 are maneuvered during the application process.

Within supply 160, each carrier 10 is connected to the next adjacent carrier 10, either in front or in back thereof, by two frangible links 162 and 164. The first frangible link 162 is provided by the interconnection of lobes 166 and 168 projecting outwardly of first and second end struts 132 and 134, respectively, near the juncture of end struts 132 and 134 to stringer 84. Thus, first frangible link 162 comprises the interconnection of lobe 168 from second strut 134 of a downstream carrier 10 with lobe 166 of first end strut 132 of an upstream carrier 10. Further, first frangible link 162 is provided outwardly of lines of stress defined by struts 132 and 134 of adjacent carriers 10, between handle portions 12 and the outer most loops in arrays 50 and 70. Second frangible link 164 comprises the interconnection of outermost sleeves in arrays 50 and 70. Thus, as illustrated in FIG. 4, loop 82 of a down stream carrier 10 is connected to loop 72 of the next adjacent upstream carrier 10.

It should be understood that FIG. 4 illustrates only first sheets 20 of the adjacent carriers 10, and that juxtaposed there behind are identical second sheets 22 for each carrier 10. Similar frangible links 162 and 164 are provided between adjacent second sheets 22 of each adjacent carrier 10.

As illustrated in FIG. 4, with first frangible link 162 provided on lobes 166 and 168 extending outwardly of struts 132 and 134, and second frangible link 164 provided by the outer edges of adjacent loops 72 and 82, each link 162 and 164 is thereby provided outwardly of weld 28. Specifically first and second ends 170 and 172 of weld 28 are located within recesses 174 and 176 formed between lobes 166 and. 168 and loops 72 and 82, respectively. Frangible links 162, 164 are provided on opposite sides of weld 28.

Advantageously, first frangible link 162 and second frangible link 164 are each provided as perforations in the contiguous sections of sheets 20 and 22. Thus, each frangible link 162 and 164 is readily fractured along perforation lines 178 and 180, respectively. Individual carriers 10 are stable within supply 160 as a result of the frangible links 162 and 164 provided on opposite sides of weld 28.

During use of carrier 10, individual carriers 10 are separated from supply 160 by fracturing frangible links 162 and 164 along perforation lines 178 and 180. Containers can be secured in each loop 52, 54, 56, 58, 60, 62, 72, 74, 76, 78, 80 and 82 by stretching each loop to surround the container. Machines for performing the separating, stretching and attaching procedures are known to those skilled in the art, and will not be described in detail herein.

Each loop 52, 54, 56, 58, 60, 62, 72, 74, 76, 78, 80 and 82 is formed contiguous with loops adjacent it within its respective array 50 or 70. Further, each loop 52, 54, 56, 58, 60, 62, 72, 74, 76, 78, 80 and 82 is formed contiguous with stringer 84 of its sheet 20 or 22. Therefore, other than from minimal material stretching, the relative positions for each bottle in rows 90 and 110 remains the same relative to stringers 84, even as carrier 10 is lifted. The configuration of suspension portion 16 restricts the relative movement between handle portion 12, and particularly top segment 30 thereof, relative to stringers 84. Thus, as carrier 10 is lifted and the full weight of bottles 92, 94, 96, 98, 100, 102, 112, 114, 116, 118, 120, 122 is suspended from top segments 30, other than from minimal material stretching, the relative spacing between top segments 30 and stringers 84 remains relatively constant. End struts 132 and 134 stabilize the relative positioning of handle ends 38 and 40 relative to stringers 84 such that the handle ends can not move further away from stringers 84 as weight is applied thereto when carrier 10 is lifted. Center struts 136 and 138 and elbow members 144 and 146 restrict relative movement of handle portion 12 relative to arrays 50 and 70. A person lifting a fully loaded carrier 10 senses stability and firmness in the carrier.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A container carrier comprising:

a handle having a first end and a second end, said handle having a handle length between said first handle end and said second handle end;

an array of loops for holding containers arranged in a row and connected to each other, said array including a first end loop and a second end loop, with remaining said loops disposed between said first end loop and said second end loop, said array having an array length between said first array end and said second array end, said handle length being less than said array length; and a suspension portion interconnecting said handle and said array, said suspension portion including a substantially linear first end strut connecting said first end of said handle to said first end loop, and a substantially linear second end strut connecting said second end of said handle to said second end loop, said first and second struts angling outwardly from said handle to said array.

2. The carrier of claim 1, including first and second sheets juxtaposed on each other, said sheets being joined to each other, each said sheet having a handle portion with first and second ends, a container holding portion including an ray of loops, and a suspension portion interconnecting said handle portion and said array.

3. The carrier of claim 2, each said array including six said loops.

4. The carrier of claim 2, each said sheet including a stringer extending adjacent said loops of the sheet, joining said suspension portion and said array, said handle of each sheet having a handle length less than a length of said stringer, and said first and second struts of each said sheet angling outwardly from said handle to said stringer.

5. The carrier of claim 4, each said sheet including a center strut between said handle thereof and said stringer thereof.

6. The carrier of claim 4, each said sheet including a beam disposed between said handle and said stringer thereof, said beam having a beam length less than said handle length; a first elbow member connected to said first handle end, said beam and said stringer; and a second elbow member connected to said second handle end, said beam and said stringer.

7. The carrier of claim 1, including a beam disposed between said handle and said array, said beam having a beam length less than said handle length, a first elbow member connected to said first handle end, said beam and said array, and a second elbow member connected to said second handle end, said beam and said array.

8. The carrier of claim 7, including braces from central portions of said end struts to said elbow members.

9. A container carrier comprising:

an array of loops for holding containers, said array of loops including first and second end loops and other said loops disposed in substantial alignment between said first and second end loops;

a handle including a first handle end and a second handle end;

first and second substantially linear supports extending outwardly from said first and second handle ends to said first and second end loops, respectively;

a stringer integral with each said loop, said stringer having first and second ends;

first and second substantially linear struts disposed angularly from said first and second handle ends to said first and second stringer ends;

a beam disposed in spaced relation to said handle and to said stringer;

a first elbow member connecting said first handle end, said beam and said stringer;

a second elbow member connecting said second handle end, said beam mid said stringer; and a first center strut between said handle and said beam, and a second center strut between said beam and said stringer.

* * * * *